US007628277B2

(12) United States Patent
Zietlow

(10) Patent No.: US 7,628,277 B2
(45) Date of Patent: Dec. 8, 2009

(54) PROTECTIVE ARTICLE SHIPPING CONTAINER

(75) Inventor: Richard A. Zietlow, Greensboro, NC (US)

(73) Assignee: International Paper Company, Memphis, TN (US)

( * ) Notice: Subject to any disclaimer, the term of this patent is extended or adjusted under 35 U.S.C. 154(b) by 423 days.

(21) Appl. No.: 11/796,992

(22) Filed: Apr. 30, 2007

(65) Prior Publication Data

US 2007/0251856 A1 Nov. 1, 2007

Related U.S. Application Data

(60) Provisional application No. 60/795,961, filed on Apr. 28, 2006.

(51) Int. Cl.
*B65D 81/02* (2006.01)

(52) U.S. Cl. ..... 206/591; 206/784

(58) Field of Classification Search ..... 206/784, 206/591, 592, 594, 586, 588, 486, 495, 497
See application file for complete search history.

(56) References Cited

U.S. PATENT DOCUMENTS

| | | | | |
|---|---|---|---|---|
| 2,733,851 | A | 2/1956 | Van Ness | |
| 3,587,838 | A * | 6/1971 | Miyata | 206/583 |
| 4,211,356 | A * | 7/1980 | Tsuchiya et al. | 206/586 |
| 4,792,043 | A | 12/1988 | Holladay | |
| 5,341,934 | A * | 8/1994 | Hsu | 206/591 |
| 5,711,426 | A * | 1/1998 | Kuhn et al. | 206/586 |
| 7,097,042 | B2 * | 8/2006 | Hsu | 206/751 |

* cited by examiner

*Primary Examiner*—Jacob K Ackun, Jr.
(74) *Attorney, Agent, or Firm*—Matthew M. Eslami; Thomas W. Barnes, III

(57) ABSTRACT

A container according to a preferred embodiment of the present invention provides an outer shell and an insert, which is sized, shaped and configured to at least partially enclose an article secured thereto during shipping and storing. The outer shell is of a conventional box construction, preferably an FOL container. The insert is preferably constructed of corrugated paperboard and includes a bottom wall panel to which the article is secured, at least one endwall panel having at least one gusset-forming flap extending therefrom and at least one extension flap defining a fold-over flap which can be secured to a portion of the endwall flap for the purpose of enclosing the corner portions of the article.

23 Claims, 10 Drawing Sheets

PROTECTIVE ARTICLE SHIPPING CONTAINER

The present application claims the benefit of priority under 35 USC §119(e) to U.S. Provisional Patent Application 60/795,961, filed Apr. 28, 2006, which is hereby incorporated, in its entirety, herein by reference.

BACKGROUND OF THE INVENTION

1. Technical Field of the Invention

The present invention relates to containers for shipping and storing articles which require protection during transit. More particularly, the present invention relates to containers for shipping and storing articles which require protection during transit, wherein a foldable insert is used to surround the article and suspend the article within a protective outer shell.

2. Brief Description of the Related Art

It is known to ship articles in generally parallelepiped containers constructed from a foldable material such as corrugated paperboard, laminated paperboard, paperboard, or the like. It is also known to utilize dunnage for the purpose of inhibiting shifting of the article within the container during transit, which such shifting may lead to undesirable damage to the article. In the case of electronic and other sensitive articles, such as, for example, after-market automotive radiators, damage to the article during transit may require that the article be scrapped, thereby leading to waste and increased cost of manufacturing and distribution.

Moreover, many articles have projections or other protuberances which are particularly susceptible to damage during transit. For example, aftermarket automotive radiators include valves, inlet and outlet fixtures which extend from the main body of the radiator. Shifting of the radiator within its container may result in these valves, fixtures, etc., breaking off entirely, being bent beyond use or otherwise becoming damaged, even though the main body of the radiator remains undamaged. In such circumstances, it is typical that the entire radiator is scrapped, even though only the valve, fixture, etc., was damaged. This leads to excessive waste and increased costs of production.

SUMMARY OF THE INVENTION

According to one aspect of the present invention, a container is provided comprising an outer shell and an insert, which is sized, shaped and configured to at least partially enclose an article secured thereto during shipping and storing. The outer shell is of a conventional box construction, preferably an FOL container. The insert is preferably constructed of corrugated paperboard and includes a bottom wall panel to which the article is secured, at least one endwall panel having at least one gusset-forming flap extending therefrom and at least one extension flap defining a fold-over flap which can be secured to a portion of the endwall flap for the purpose of enclosing the corner portions of the article.

These and other objects, features and advantages of the present invention become apparent to those of ordinary skill in the art from the description which follows, and may be realized by means of the instrumentalities and combinations particularly pointed out therein, as well as by those instrumentalities, combinations and improvements thereof which are not described expressly therein, but which would be obvious to those of ordinary and reasonable skill in the art.

BRIEF DESCRIPTION OF THE DRAWINGS

A better understanding of the invention will be had upon reference to the following description in conjunction with the accompanying drawings in which like reference numerals represent like parts, and wherein.

DETAILED DESCRIPTION OF THE PREFERRED EMBODIMENTS

Figure 1:
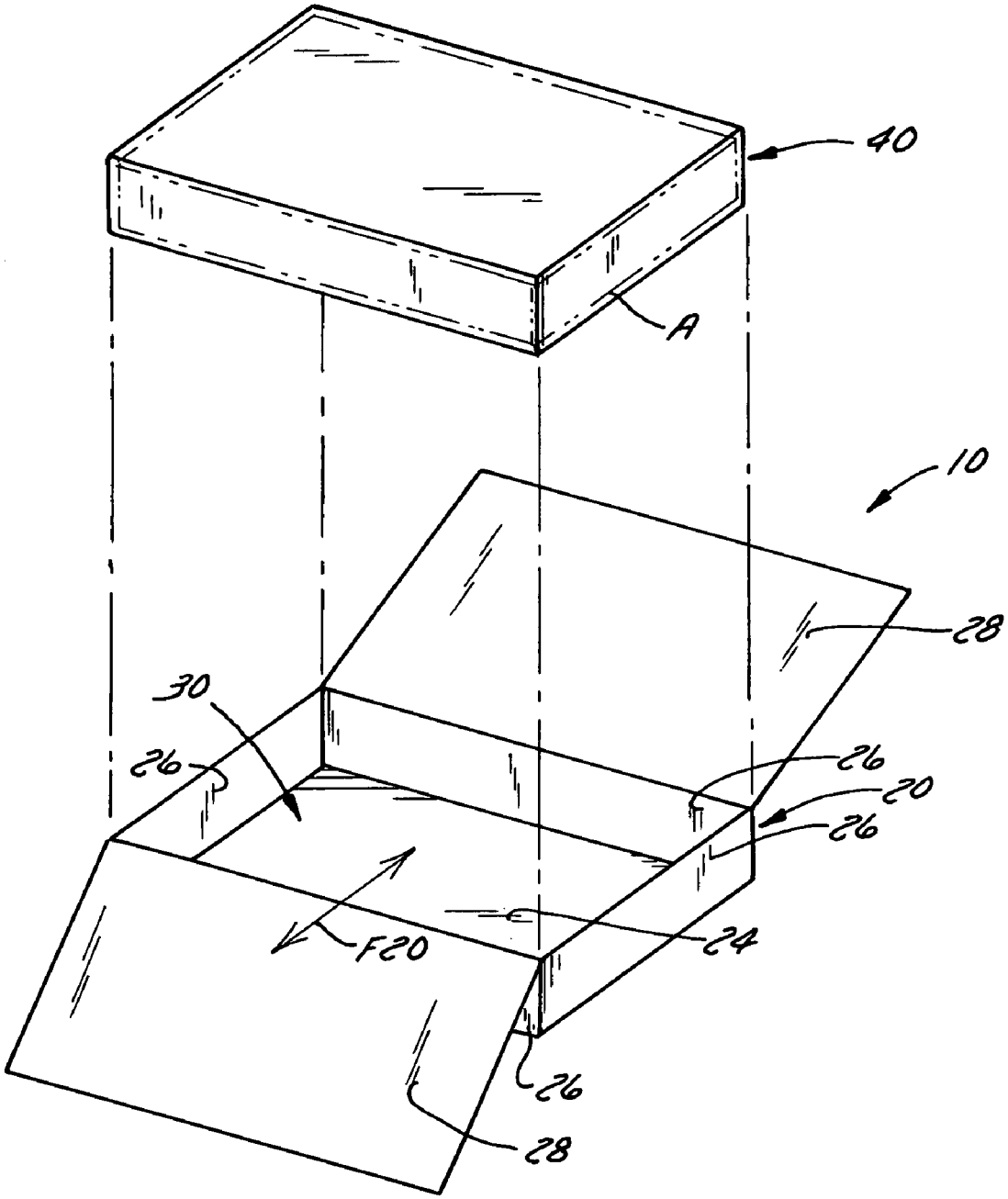
FIG. 1 is an exploded perspective view of a container according to a preferred embodiment of the present invention, wherein an insert portion of the container is shown schematically.

With reference to FIG. 1, a container 10 for shipping and storing an article A according to a preferred embodiment of the present invention is shown and comprises an outer shell 20 and a foldable insert 40. As will be described in greater detail below, the article is secured to the foldable insert 40, such as, for example, using stretch wrap, and the insert 40 is wrapped around the article A in a manner to surround the article A and reduce the likelihood that the article A will be damaged during shipping and storing. The insert 40 is sized, shaped and configured such that it fits snugly within an interior space 22 of the outer shell 20 after it has been wrapped around the article A.

The outer shell 20 preferably is constructed from a foldable material, such as corrugated paperboard, laminated paperboard, paperboard, or the like, and is of a sufficient size to encase the article A therein for shipping and storing. The outer shell 20 is of a typical configuration, such as a corrugated regular slotted container (RSC), full overlap (FOL) container, half slotted container (HSC), one piece folder (OPF) or five panel folder (FPF). Referring to FIG. 1, it can be seen that the outer shell 20 of the container 10 according to a preferred embodiment of the present invention is in the form of a conventional corrugated FOL container having a bottom wall 24, side walls 26 and a top wall defined by overlapping flaps 28. Walls 24, 26 and flaps 28 cooperate to define an interior space 30 within the outer shell 20. Preferably, if the outer shell 20 is constructed for corrugated paperboard, the flutes of the corrugated paperboard are oriented to run (lengthwise) in the direction indicated generally by reference numeral F20.

Figure 2:
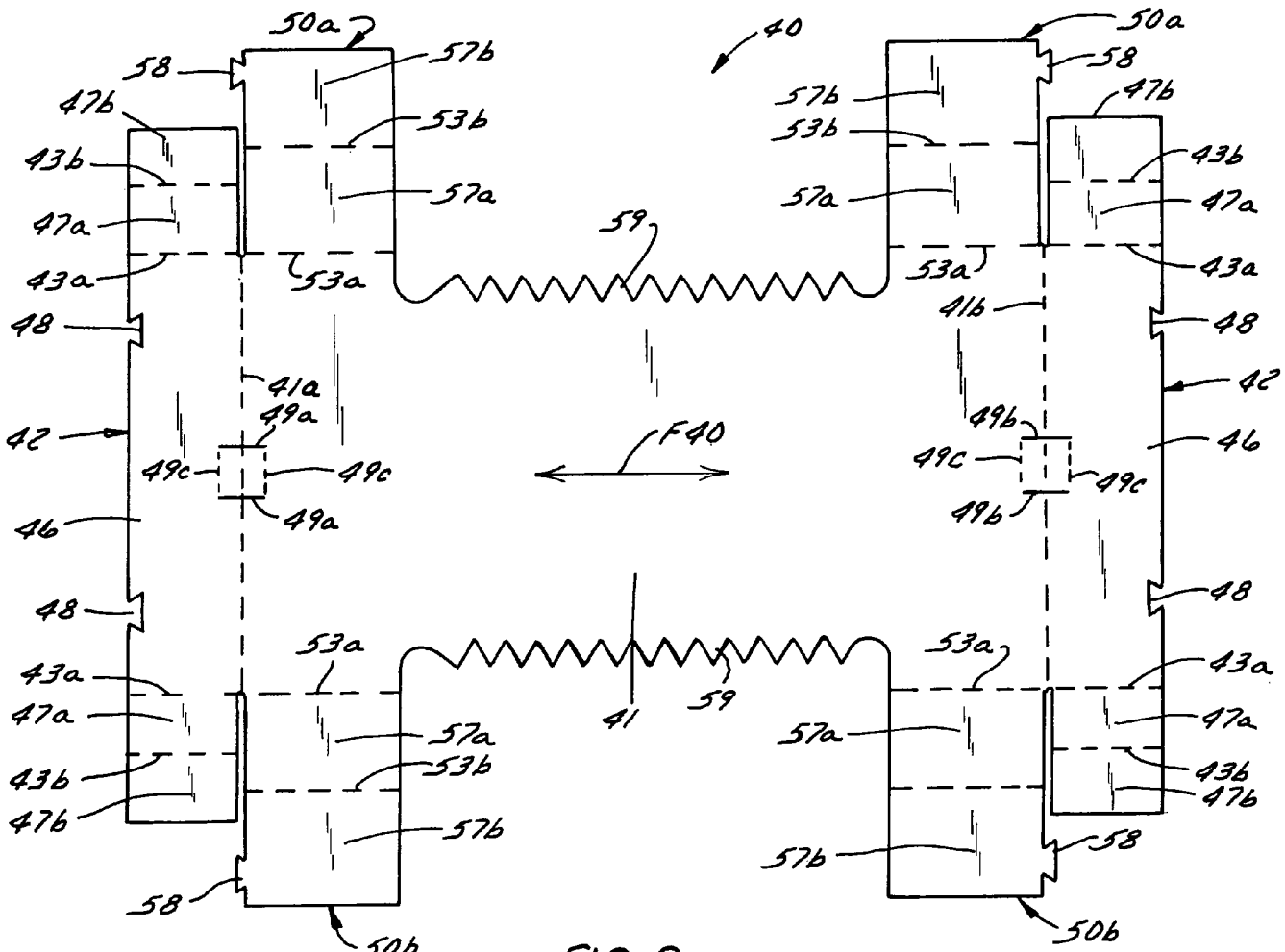
FIG. 2 is a plan view of a blank used to form an insert portion of the container shown in FIG. 1.

Referring now to FIG. 2, the insert 40 provided by the container 10 according to a preferred embodiment of the present invention is formed from a generally flat sheet of foldable material, such as corrugated paperboard, laminated paperboard, paperboard, or the like, wherein various cuts, scores, creases, slots and perforations are used to divide the sheet of foldable material into panels, flaps and tabs, as will be described in greater detail below.

The sheet of foldable material is generally rectangular in shape and includes a pair of transverse fold lines 41*a*, 41*b* which divide the sheet of foldable material into a bottom wall panel 41 and opposing endwall flaps 44, each of which extends outwardly from the bottom wall panel 41 along a longitudinal axis F40 of the insert 40. Preferably, the sheet of foldable material is die-cut from a sheet of corrugated paperboard such that the flutes of the corrugated paperboard align with the longitudinal axis F40 of the insert 40. It can be seen from FIG. 2 that endwall flaps 42 are generally opposite-handed to one another.

Each end of the endwall flaps 42 includes an inner longitudinal fold line 43*a* and an outer longitudinal fold line 43*b*, which cooperate with one another to divide each endwall flap 42 into an endwall-forming panel 46, a first gusset-forming flap 47*a* and a second gusset-forming flap 47*b*. A pair of dovetail-shaped cutouts 48 are provided in the outer edge of the endwall-forming panel 46, preferably spaced between respective inner longitudinal fold lines 43*a*. A pair of slits 49*a*, 49*b* are spaced along transverse fold lines 41*a*, 41*b* and each extend at least partway into bottom wall panel 41 and at least partway into endwall-forming panel 46. Distal ends of slits 49*a*, 49*b* are connected by scorelines 49*c*.

A pair of extension flaps 50*a*, 50*b* extend from each distal end of the bottom wall panel 41, spaced inwardly from the endwall flaps 42. Extension flaps 50*a*, 50*b* each include first and second fold lines 53*a*, 53*b*, respectively, thereby dividing each extension flap 50*a*, 50*b* into sidewall panels 57*a* and fold-over panels 57*b*. A dovetail-shaped locking tab 58 extends from an outer edge of each fold-over panel 57*b*. Longitudinal edges of the bottom wall panel 41 each are provided with a plurality of triangular-shaped teeth 59 spaced between extension flaps 50*a*, 50*b*.

Figure 3:
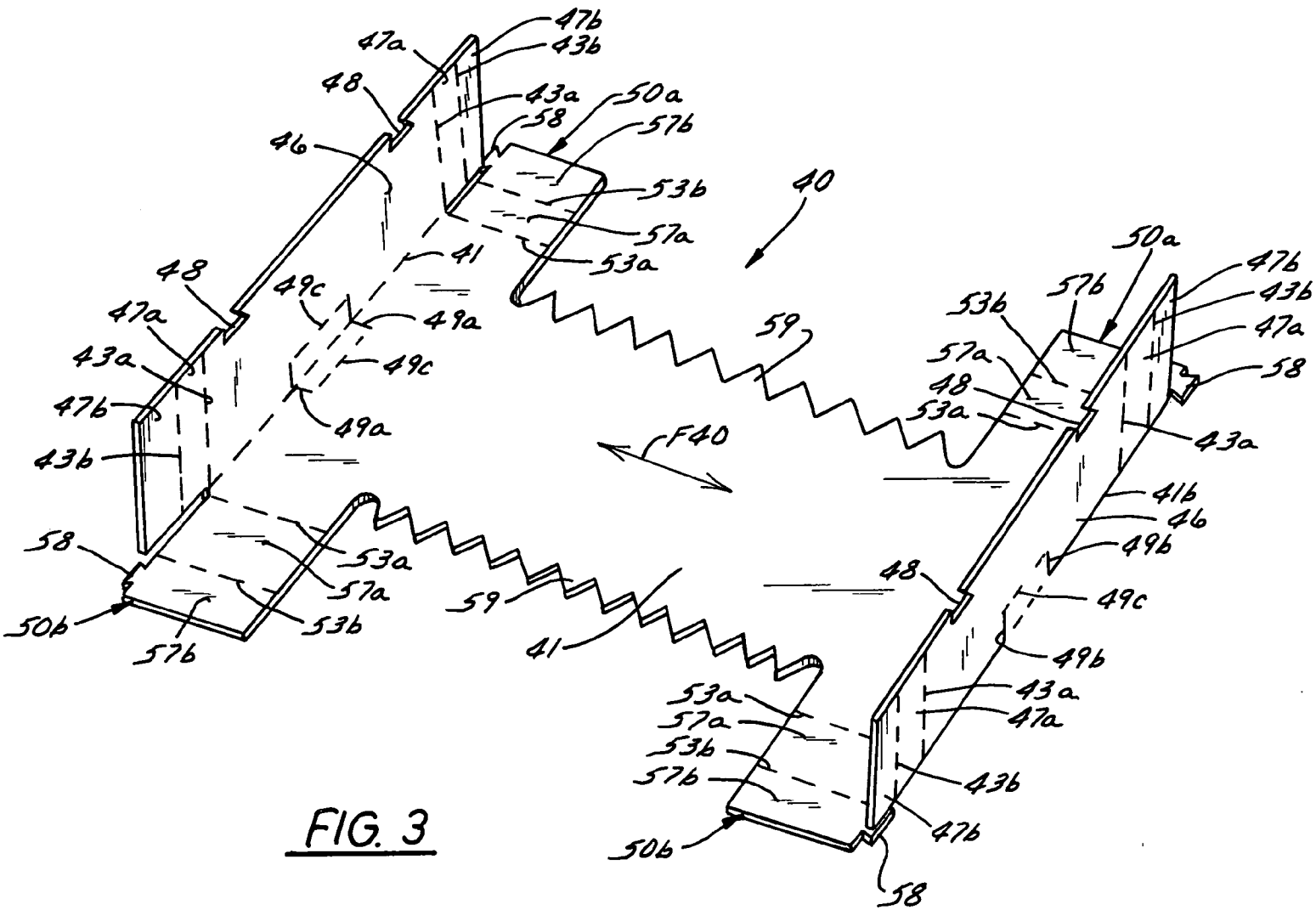
FIG. 3 is a perspective view of the insert shown in FIG. 2, wherein the insert is shown in a partially-folded configuration in which endwall flaps of the insert are folded relative to a bottom wall panel of the insert.

With reference now to FIG. 3, a first step towards assembling a container 10 (FIG. 1) according to a preferred embodiment of the present invention is to fold each endwall flap 42 of the insert 40 upwardly relative to the bottom wall panel 41 and about its respective transverse fold line 41*a*, 41*b* so that each endwall flap 42 stands at an angle of about 90 degrees relative to the bottom wall panel 41.

Figure 4:
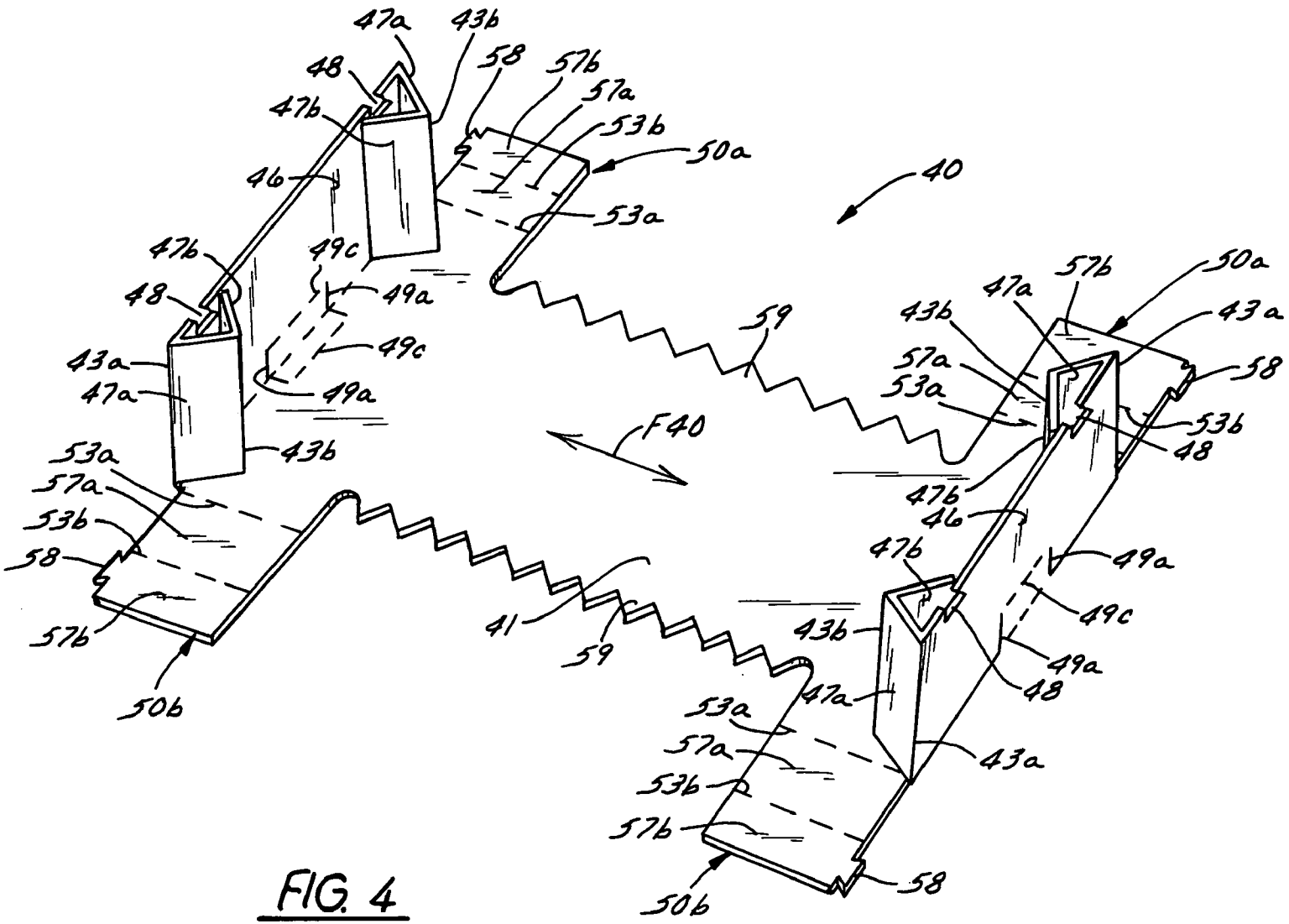
FIG. 4 is a perspective view of the insert shown in FIG. 3, wherein the insert in shown in a further partially-folded configuration in which gusset-forming flaps of the endwall flaps are folded relative to endwall-forming panels of the endwall flaps.
Figure 5:
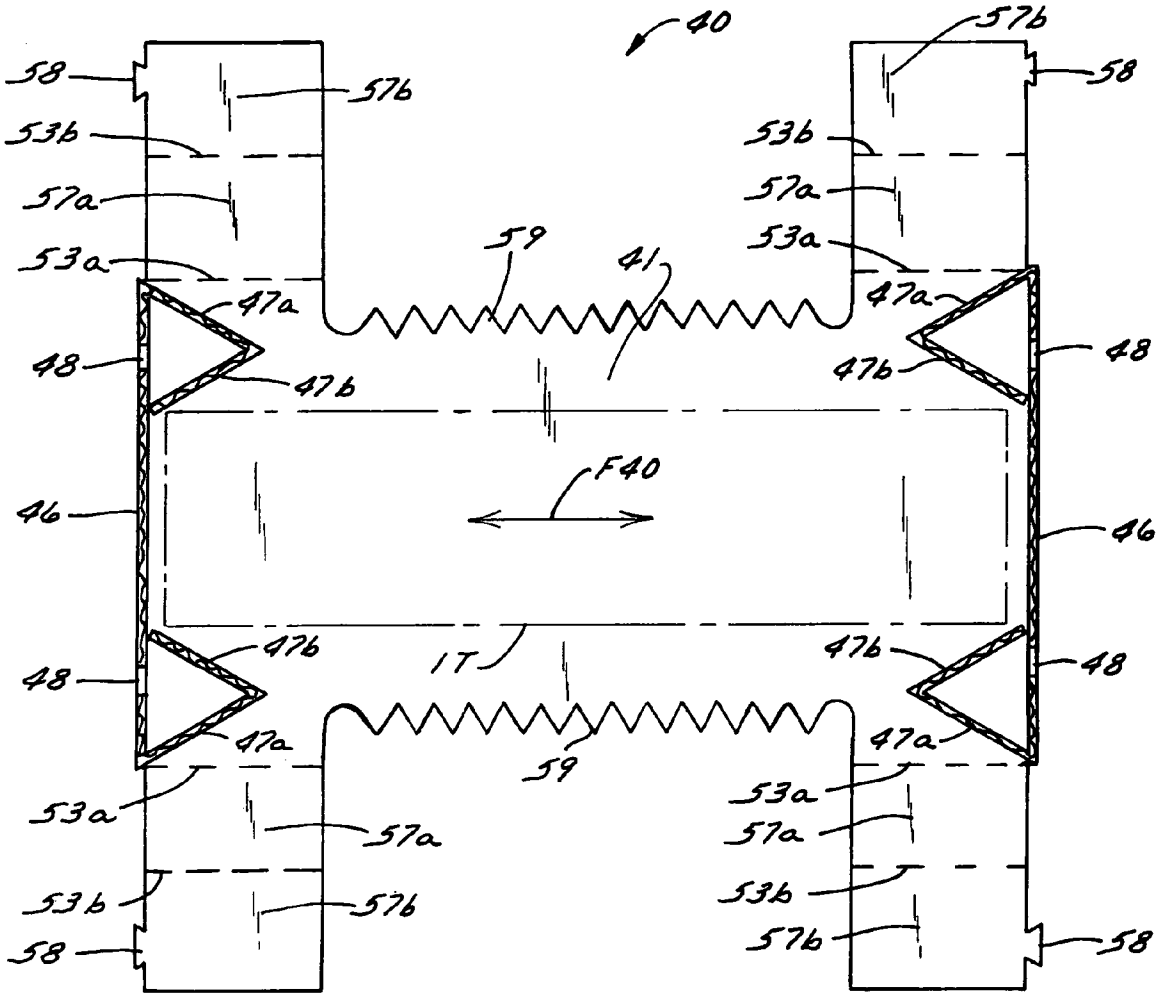
FIG. 5 is a plan view of the insert shown in FIG. 4, wherein the insert in shown in a further partially-folded configuration in which gusset-forming flaps of the endwall flaps are folded relative to endwall-forming panels of the endwall flaps, and wherein an article is shown positioned over a central region of the insert.

With reference now also to FIGS. 4 and 5, reinforcing corner gussets are formed in each corner of the erected insert 40 by first folding the first gusset-forming flaps 47*a* inwardly about inner longitudinal fold lines 43*a* such that first gusset-forming flaps 47*a* extend towards an interior space of the erected insert 40, and thereafter folding second gusset-forming flaps 47*b* further inwardly about outer longitudinal fold lines 43*b* such that each second gusset-forming flap 47*b* extends towards its respective endwall panel 46, thereby forming an upstanding triangularly-shaped column having a main axis which is perpendicular to the longitudinal axis F40 of the insert 40. The particular angles at which first and second gusset-forming flaps 47*a*, 47*b*, respectively, are oriented relative to one another, relative to the endwall panels 46 and relative to bottom wall panel 41 may be changed without departing from either the spirit or the scope of the present invention. Furthermore, distal ends of the second gusset-forming flaps 47*b* may be secured or otherwise attached to endwall panels 46 by any conventional means, such as adhesive. An additional flap or tab (not shown) may extend from the distal ends of the second gusset-forming flaps 47*b* for this purpose.

Corner gussets (defined by folded-in gusset-forming flaps 47*a*, 47*b*) further provide side-to-side support for an article IT situated within the interior space of the insert 40. That is, gusset-forming flaps 47*b* present an angled face to corner portions of the article IT, thereby limiting movement of the article IT in two directions within a plane that is generally parallel to the plane in which the bottom wall panel 41 lies. The size, shape, orientation and configuration of the gusset-forming flaps 47*a*, 47*b* can be selected in view of the particular article IT to be shipped by the container 10.

Figure 6:
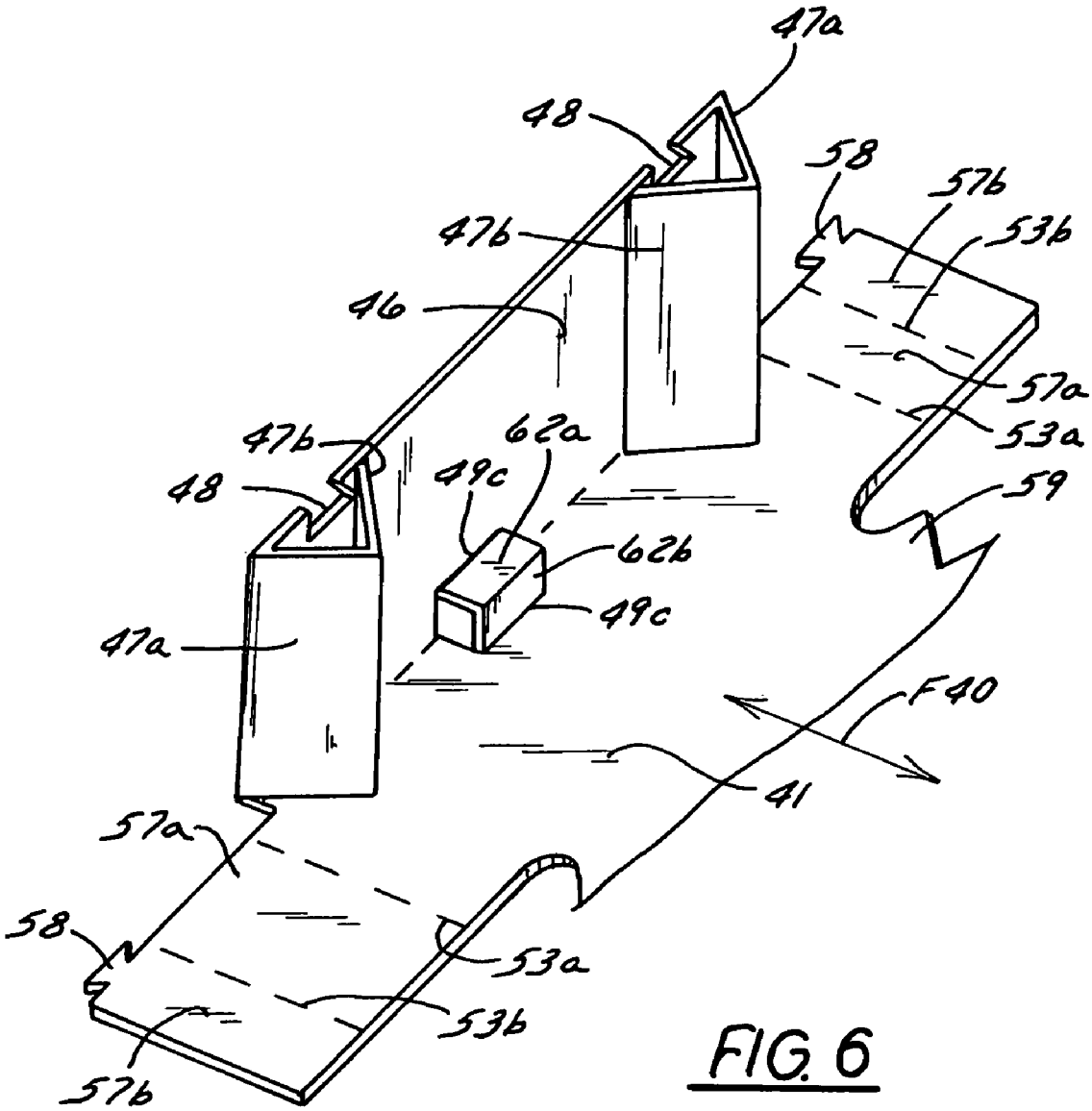
FIG. 6 is a perspective view of one end of the insert shown in FIG. 4, wherein integral positioning blocks are shown extending into an interior space of the insert.

Slits 49*a*, 49*b* and scorelines 49*c* cooperate with one another to define first and second block-forming panels 62*a*, 62*b*, respectively, wherein a first block-forming panel 62*a* is situated within each endwall panel 46 and wherein a second block-forming panel 62*b* is situated in the bottom wall 41. Block-forming panels 62*a*, 62*b* can be "snapped" into an inwardly-extending position (such as is shown in FIG. 6), by applying a slight amount of inwardly-directed force to the junction of the panels 62*a*, 62*b*, roughly in the area of the transverse foldlines 41*a*, 41*b*. As can be seen from FIG. 6, such an inwardly-extending position of the panels 62*a*, 62*b* defines an inwardly-extending block, which can serve to restrict movement of the article IT within the interior space of the insert 40 along the longitudinal axis F40 thereof. Of course, the size, shape, orientation and position of the foldlines 49*c* and the slits 49*a*, 49*b* can be selected to achieve a specifically sized block. That is, as the distance between foldlines 49*c* and transverse foldline 41*a* increases, the greater the distance "into" the interior space of the insert 40 in which the block will reside.

Referring now back to FIG. 5, once the article IT has been positioned on the insert 40 within the interior space (which may be further defined by the gusset-forming flaps 47*a*, 47*b* and the block-forming panels 62*a*, 62*b*), the article IT is secured to the bottom wall panel 41 of the insert 40, such as, for example, by conventional straps or stretch-wrap material. Preferably, conventional stretch-wrap material is used, which can be wrapped around the article IT and the bottom wall panel 41 repeatedly to ensure that the article IT remains secured to the insert 40 during shipping and storage. For this purpose, teeth 59 allow the shrink-wrap material to "grip" the bottom wall panel 41, thereby inhibiting side-to-side movement of the article IT generally along the longitudinal axis F40 of the insert 40.

While it has been observed that so-called "parts kits" which are oftentimes shipped loosely within conventional shipping containers get lost due to the fact that they are loose within such conventional containers, the insert 40 of the present invention allows such parts kits (not shown) to be wrapped within the last several layers of stretch-wrap, thereby keeping the parts kit closely associated with the article IT itself.

Figure 7:
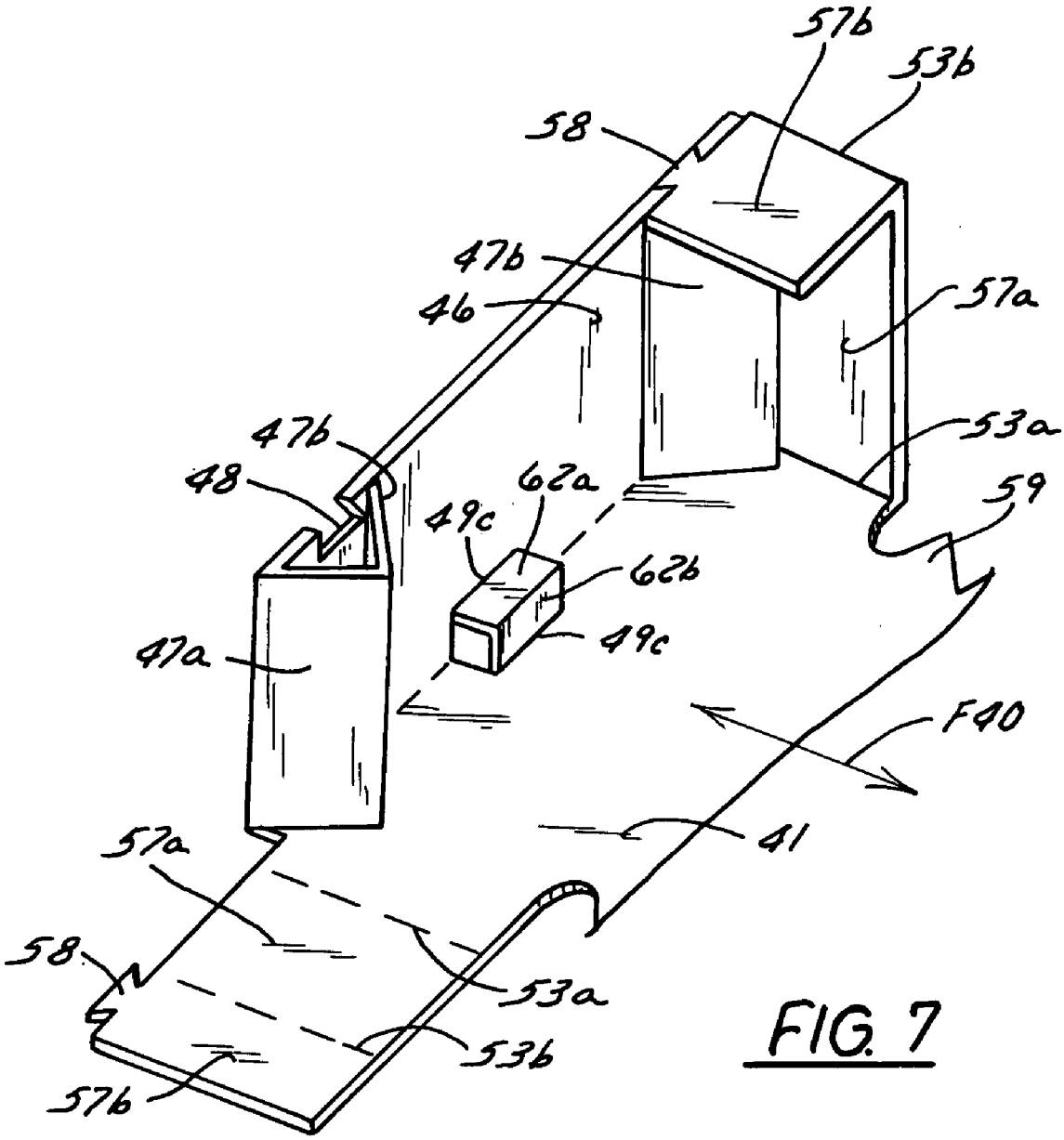
FIG. 7 is a perspective view of one end of the insert shown in FIG. 4, wherein extension flaps are shown in a wrap-around position and locked to endwall panels of the insert.

With reference to FIG. 7, once the article IT has been secured to the bottom wall panel 41, such as, by stretch-wrap material, extension flaps 5*a*, 50*b* are folded upwardly about first fold lines 53*a* such that sidewall panels 57*a* are upstanding and oriented generally perpendicularly to both the bottom wall panel 41 and the endwall panels 46. Fold-over panels 57*b* then are folded downwardly about fold lines 53*b* generally over the folded-in gusset-forming panels 47*a*, 47*b* such that fold-over panels 57*b*, endwall panels 46, and gusset-forming panels 47*a*, 47*b* and sidewall panels 57*a* cooperate with one another to generally encompass and protect the corner portions of the article IT. Tabs 58 and cutouts 48 are positioned on their respective panels 57*b*, 46, respectively, such that tabs 58 snap into cutouts 48 when the fold-over panels 57*b* are folded downwardly as described above. The lengths and widths of the extension flaps 50*a*, 50*b* are selected to provide greater (or lesser) coverage of the corner regions of the insert 40.

Figure 8:
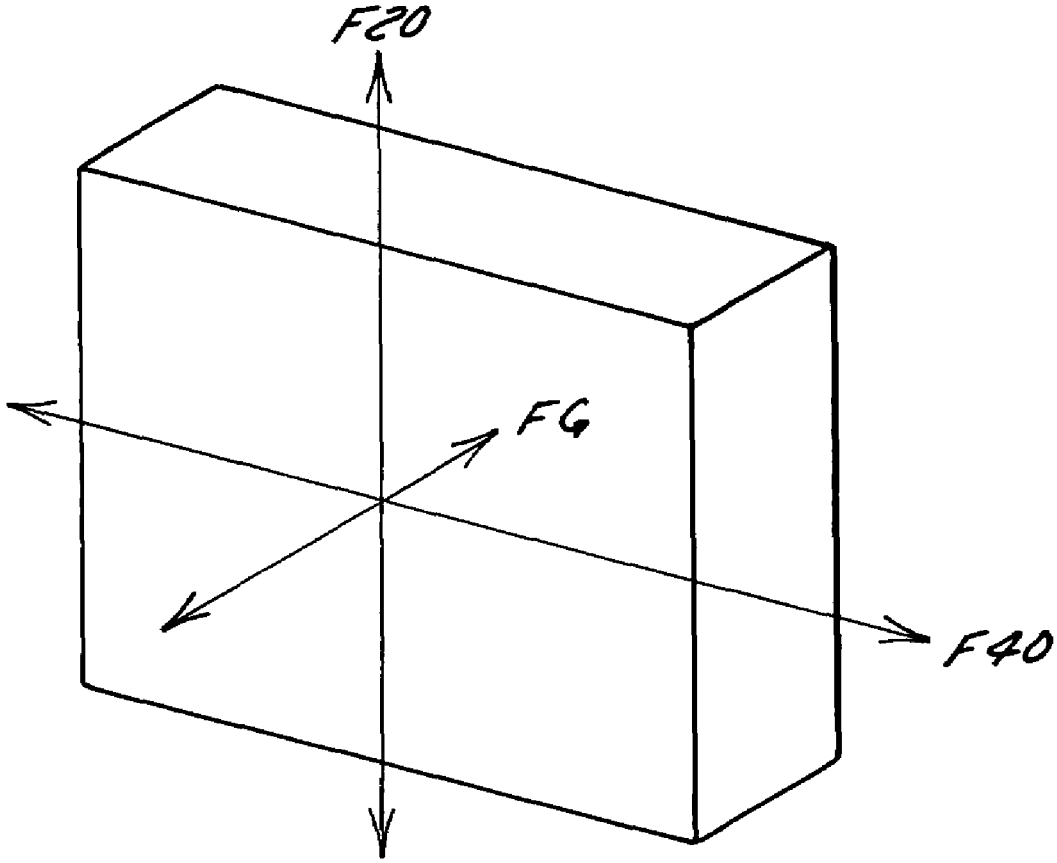
FIG. 8 is a perspective schematic diagram of the container according to a preferred embodiment of the present invention, showing strength properties in multiple dimensions.

The insert 40 (within the article IT affixed thereto and wrapped therein) is then inserted into the outer shell 20. Referring to FIG. 8, it will be obvious to one of ordinary skill in the art that the container 10 according to the present invention provides a reinforced protective article shipping container 10 that is much stronger than those provided conventionally. For example, the selection of the flute directions for each of the components ensures that the container 10 has sufficient stacking, shipping and storage strength in all three dimensions. The flute direction F20 of the outer shell 20 provides strength in a first direction; the flute direction F40 of the insert 40 provides strength in a second direction which is perpendicular to the first direction; and, the flute direction F40 of the insert 40 together with the inwardly-folded gusset-forming flaps 47*a*, 47*b* provides strength in a third direction FG that is perpendicular to both the first and second directions F20, F40. In this manner, articles IT shipped within containers 10 according to a preferred embodiment of the present invention can be stacked in any orientation without fear that the weight of such stacks will result in damage to the article IT.

In addition, since the insert 40 is sized to fit snugly within the outer shell 20, and since the article IT is secured firmly to the insert IT, there is little risk that the article will shift in any direction during shipping or storing. Not only does this reduce risk that the article IT itself will be damaged during shipping or storing, but it also reduces the risk that any protuberance or other projection extending from the article IT will become damaged during shipping or storing, either by contacting an inner surface of the outer shell 20 or by piercing the outer shell 20 and extending therefrom.

Figures 9, 9A, 9B:
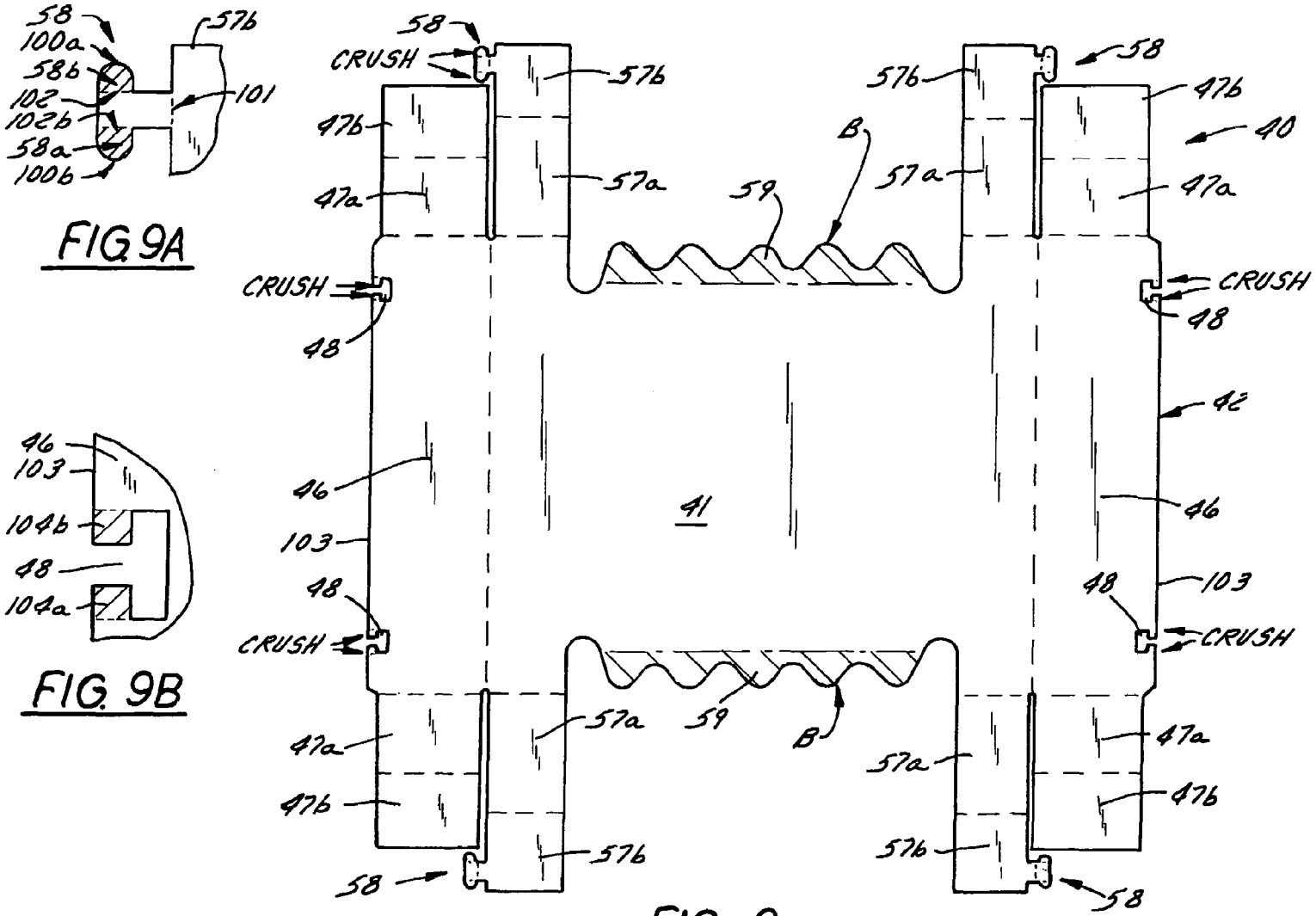
FIG. 9 is a plan view of a blank used to form an insert portion of the container shown in FIG. 1 having selected crush zones located therein.
FIG. 9A is a portion of the blank shown in FIG. 9 illustrating an enlarged view of a dovetail-shaped locking tab.
FIG. 9B is a portion of the blank shown in FIG. 9 illustrating an enlarged view of a dovetail-shaped cutout.

In an additional embodiment, the insert 40, may be constructed with one or more crush zones as shown in FIG. 9. Any one or more crush zones shown may be utilized such that any combination thereof is feasible. These crush zones facilitate the folding of the insert into its functional housing to secure and wrap around the article IT and snugly fit within the interior space 22 of the outer shell 20. As indicated in FIG. 9 at B, any one or more of the teeth 59 of the insert 40 may be crushed. FIG. 9 demonstrates an embodiment where all teeth contain crush zones, but any one or more may contain crushed zones B. Also, the entirety of each tooth may crushed. Alternatively, only a portion of each tooth may be crushed.

In addition, while the locking tab 58 may be of any shape including a dovetail shape, any one or more locking tabs 58 may be crushed. The locking tab 58 may be crushed in its entirety. Alternatively, portions of the locking tab 58*a* and 58*b*, may be crushed. FIG. 9 shows one embodiment where the portions of the locking tab 58*a* and 58*b* begin at each outside edge thereof 100*a* and 100*b* and progress inward of the locking tab 58 to at least one line 102*a* and 102*b* that is approximately perpendicular to a line 101 that foldably connects the locking tab to the fold over panel 57*b*. Of course, any portion of the locking tab may be crushed and the locking tab may be of any shape.

Still further, while the cut out 48 may be of any shape including a dovetail shape, any one or more areas surrounding the cut outs 48 may be crushed (see FIG. 9). In one embodiment, the shape of the cut out 48 may be defined by an outer edge 103 of the end wall forming panel 46. For example, the entire edge that defines the cut out 48 area may be crushed. Alternatively, only a portion thereof the edge defining the cut out may be crushed. FIG. 9 shows one embodiment where only a portion of the edge 103 defining the cut out 58 is crushed. More specifically, cut out flaps 104*a* and 104*b* are crushed. In alternative embodiments, the cut out flaps 104*a* and 104*b* may be any shape which may or may not be dictated by the shape of the cut out 48 that is positioned at the outside edge 103 of the end wall forming panel 46.

Figure 10:
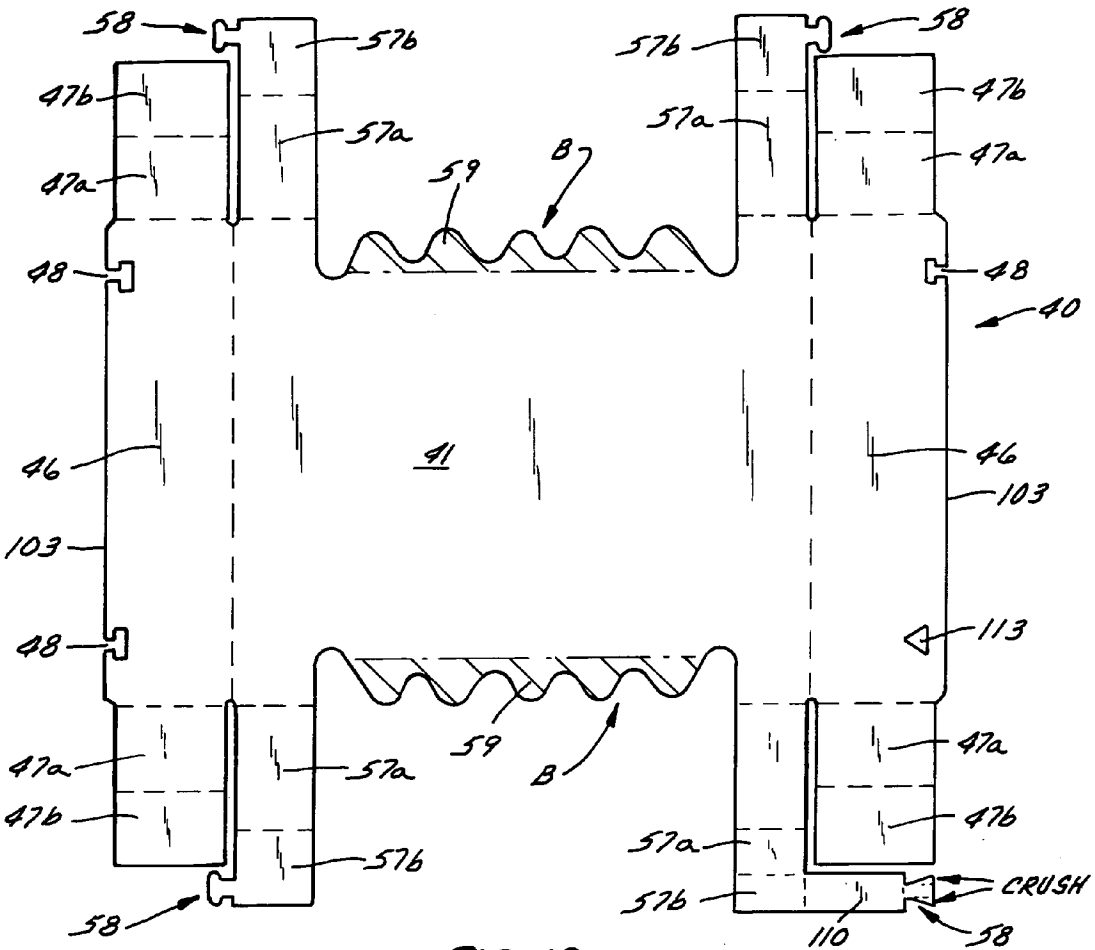
FIG. 10 is a plan view of a blank used to form an insert portion of the container shown in FIG. 9 having a locking tab extension panel extends over from a fold over panel located therein.
Figure 10A:
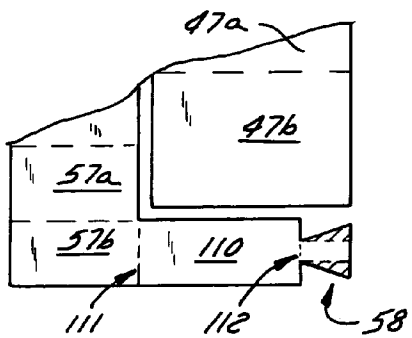
FIG. 10A is a portion of the blank shown in FIG. 10 illustrating an enlarged view of the locking tab extension panel.

In another embodiment of the present invention which may be used in isolation or with any one or more embodiments discussed above, a locking tab extension panel 110 extends from the fold over panel 57*b* (see FIG. 10). The locking tab extension panel 110 may be foldable connected to the top edge of fold over panel 57*b* via a line 111, preferably a score and/or fold line. The locking tab 58 may then extend from locking tab extension panel 110. The locking tab 58 may be foldably connected to the top edge of the locking tab extension panel 110 via a line 112, preferably a score and/or fold line. Again, the locking tab may be any shape so long as it acts to engage or snap into the corresponding cut out 48. Further in this embodiment, the cut outs 48 may or may not be positioned along the top edge of the end wall forming panel 46. In one instance shown in FIG. 10, the cut outs are not positioned along the top edge of the end wall forming panel 46. Instead, cut outs 48 are formed somewhere in an interior of the end wall forming panel 46 so as to form a hole 113 in the end wall forming panel 46 at a position and in any shape that is sufficient to accept and frictionally engage the locking tab 58 that, in this embodiment, is attached to a locking tab extension panel 110. Further, the entire locking tab may or may not be crushed (as discussed above) or a portion of the locking tab 58 may be crushed (as discussed above).

While the invention has been described and illustrated with reference to one or more preferred embodiments thereof, it is not the intention of the applicants that the invention be restricted to such detail. Rather, it is the intention of the applicants that the invention be defined by all equivalents, both suggested hereby and known to those of ordinary skill in the art, of the preferred embodiments falling within the scope hereof.

I claim:

1. A container for shipping an article, comprising:

an outer shell defining an interior space;

an insert having a bottom wall panel to which the article is secured;

at least one end wall, end panel or endwall flap having at least one gusset-forming flap extending therefrom; and at least one extension flap having a fold-over flap adapted to be secured to a portion of the endwall flap for the purpose of enclosing a corner portion of the article.

2. The container according to claim 1, wherein the outer shell is at least one member selected from the group consisting of a regular slotted container, full overlap container, half slotted container, one piece folder, and five panel folder.

3. The container according to claim 1, wherein the at least one end panel has a length that is shorter than that of the insert.

4. The container according to claim 1, wherein the at least one end panel has a length that is equal to or longer than that of the insert.

5. The container according to claim 1, wherein the at least one extension flap extends from a distal end of the bottom wall.

6. The container according to claim 1, wherein the extension flap further comprises a side wall panel.

7. The container according to claim 1, wherein a locking tab extends from the fold over flap.

8. The container according to claim 7, wherein the locking tab is in the shape of a dovetail.

9. The container according to claim 7, wherein at least a portion of the locking tab is crushed.

10. The container according to claim 7, wherein a cut out is formed in the end wall.

11. The container according to claim 10, wherein the cut out is formed along the upper edge of the end wall.

12. The container according to claim 11, wherein the cut out is formed along the upper edge of the end wall to form cut out flaps.

13. The container according to claim 12, wherein the cut out flaps are crushed.

14. The container according to claim 11, wherein upper edge of the end wall surrounding the cut out is at least partially crushed.

15. The container according claim 11, wherein the locking tab is frictionally engaged with the cut out.

16. The container according to claim 1, wherein a locking tab extension panel extends from the fold over flap and a locking tab extend from the locking tab extension panel.

17. The container according to claim 14, wherein a cut out is formed along the interior of the end wall, defining an opening.

18. The container according claim 15, wherein the locking tab is positioned through the opening and is frictionally engaged with the cut out.

19. The container according to claim 15, wherein a portion of edges of the end panel that define the cut out opening are crushed.

20. The container according to claim 1, further comprising a securing means that affixes the article to the insert.

21. The container according to claim 17, wherein at least one tooth extends from a longitudinal side of the bottom wall such that the tooth may frictionally engage the article, the securing means, or both.

22. The container according to claim 18, wherein the at least one tooth is triangular shaped.

23. The container according to claim 19, wherein there are a plurality of teeth and the securing means is at least one member selected from the group consisting of stretch wrap, shrink wrap, and conventional straps.

* * * * *